US005913518A

United States Patent [19]

Demlow

[11] Patent Number: 5,913,518

[45] Date of Patent: Jun. 22, 1999

[54] METHOD OF PLAYING A LEARNING GAME

[76] Inventor: Durand K. Demlow, 17016 Crestview Dr., Lake Oswego, Oreg. 97034

[21] Appl. No.: 08/877,144

[22] Filed: Jun. 17, 1997

[51] Int. Cl.[6] ..... A63F 3/00

[52] U.S. Cl. ..... 273/247; 273/248; 273/287; 273/430

[58] Field of Search ..... 273/247, 243, 273/249, 429–432, 260, 287, 148 R, 239, 248; 434/331

[56] References Cited

U.S. PATENT DOCUMENTS 5,087,051 2/1992 LoBue ..... 273/247
5,314,197 5/1994 Hersch ..... 434/331

FOREIGN PATENT DOCUMENTS 512453 11/1992 European Pat. Off. ..... 273/239

*Primary Examiner*—Benjamin H. Layno

[57] ABSTRACT

A game for entertainment as well as learning. The game is provided on a case which also serves as a storage container. One side of the case has a field of play that simulates a real life game. Game pieces are provided on the other side and include questions on cards that must be answered correctly for a player to have a chance to advance a token on the field of play. The answer to the question is revealed in an answer window. Spinners are provided with markings to indicate the movement of the token. The rules of the game are variable to be suited to the age group of the players.

2 Claims, 5 Drawing Sheets

METHOD OF PLAYING A LEARNING GAME

FIELD OF THE INVENTION

This invention relates to a game that is designed to combine entertainment with learning and more particularly to combine chance and knowledge and utilizes cards, spinners, a playing field and advancement pieces.

BACKGROUND OF THE INVENTION

There are many, many forms of games. Certainly many resemble sports events. Many comprise movement of pieces across or around a game board. Many comprise chance cards requiring answers. Many comprise the use of spinners. None combine all of these forms and add elements of learning a sport, e.g., soccer, as well as progression through the different game activities.

An objective of the invention is to provide a learning tool for young sports enthusiasts (although the game certainly is not limited to the young). A further objective is to provide a game that involves a stepped process of answering questions, spinning for a chance advancement on a game board and connecting the three activities to scoring opportunities as in a real sports event. A still further object is to provide the game/learning tool on a playing field that itself becomes the storage container with storage achieved essentially with the game components remaining in place allowing the game to be interrupted, moved and set up with the components all still in place as they were when the game was interrupted.

BRIEF DESCRIPTION OF THE INVENTION

The preferred embodiment of the present invention involves a game field, soccer, hockey, golf and including hockey rink, basketball floor, football field and the like. It also includes game pieces (soccer ball, hockey puck, football, etc.) and field positions in which the pieces are advanced toward a goal (basketball basket, end zone of a football field, cup of a golf green, etc.). Movement of the game pieces is accomplished by answering questions (randomly provided on game cards selected by a player) and where successful, providing a chance movement, e.g., provided on a disk on which a spinner determines the movement activity of the game piece.

The game field is provided on one-half of a fold out carrying case. The game pieces are movable on the game field and are releasably held in position on the game field through hook and loop attachment (e.g., Velcro®). Holding areas are inset into the surface of the "other" half for the cards, discards, score markers and game pieces. A pair of spinning devices are provided on the other half. The spinning devices may be permanently affixed to the other half.

The various elements and the satisfaction of the above-stated objectives will be more fully appreciated upon reference to the following detailed description having reference to the accompanying drawings.

DESCRIPTION OF THE PREFERRED EMBODIMENT

The learning game of the present invention provides entertainment of play as well as a learning tool. The game simulates play of well known sports activities such as soccer, football, basketball, hockey, golf and the like. The game has a game board which simulates a playing field, court or the like on which the game is played. The game has a random selection process in which a playing member must answer a question correctly in order to have a chance for advancing a playing token on the playing field. When a question is answered correctly, the player then activates a device that determines the advancement of the token on the playing field. The player continues to answer randomly selected questions until that player comes up with an incorrect answer and then the play reverts to an opposing member. The opposing member will then randomly select an item that has a question on it and will proceed to attempt to answer the question. To further enhance the entertainment of the game, the device that has the selection for advancing the game token also has positions that will place the player into a bonus round. The learning game of the present invention will be more fully understood by the following description of an example game.

Figure 1:
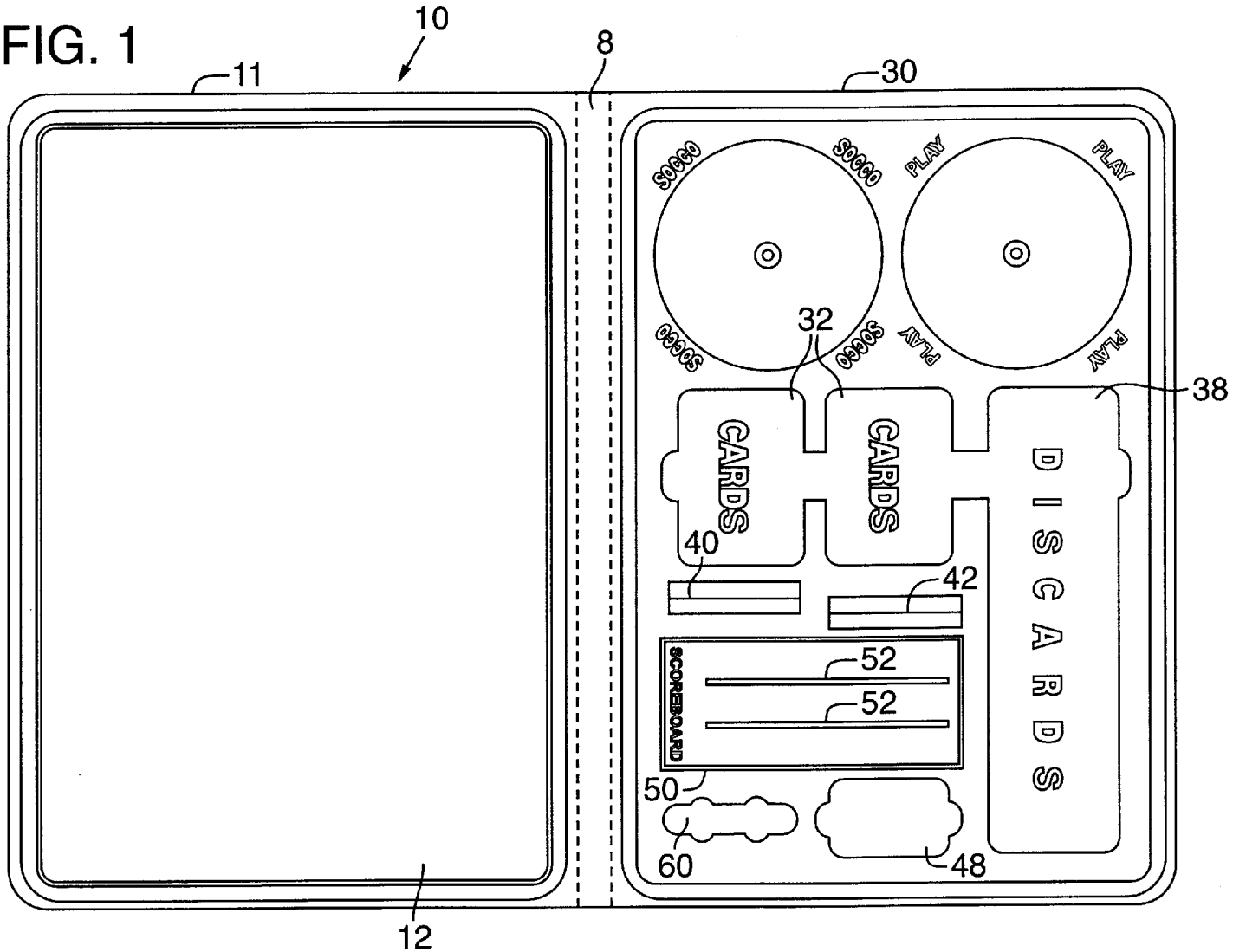
FIG. 1 is a view of a game case arranged to incorporate a learning game of the present invention.

Refer now to FIG. 1 of the drawings which illustrates a case 10 (game board) which is arranged to store all of the components of the learning game of the present invention. One side 11 of the case 10 has a field of play which will hereafter be referred to as a field 12. The field 12 is arranged similar to a real life game such as a soccer field, a football field, a basketball court, a hockey rink and the like. The opposite side 30 of the case 10 houses all of the items necessary to play the game such as play selectors, cards, scoreboard, field markers and the like. The case 10 is arranged to be closed with the side 11 fitting on side 30. A center spine 8 acts as a hinge. The case 10 is arranged to store the game components in individual storage receptacles and is also arranged to store the articles of play such as the cards in the position attained during a game so that the game may be resumed at a later time.

Figure 2A:
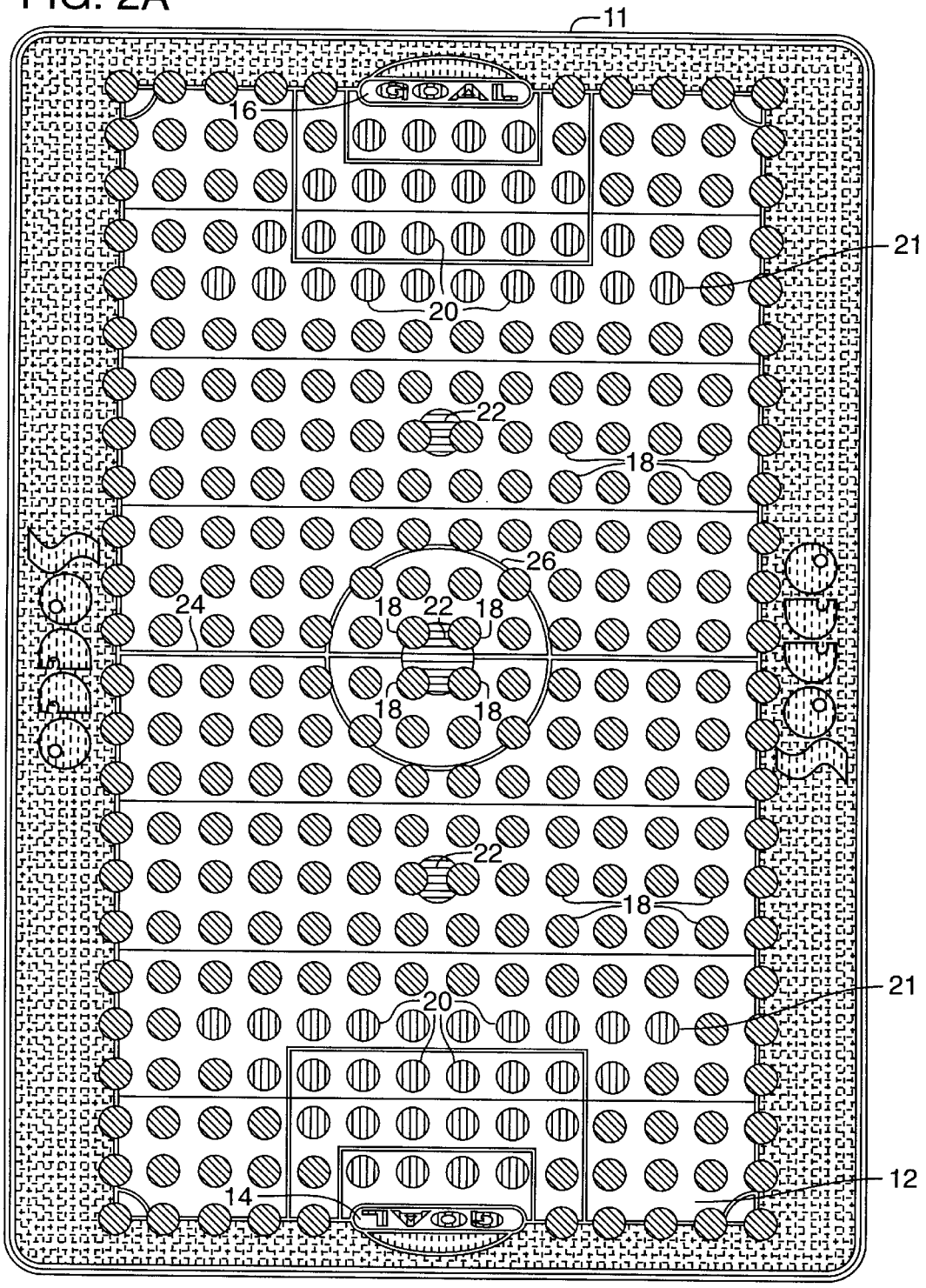
FIG. 2A is a view of one side of the case of FIG. 1 arranged with a field of play for a learning game of the present invention.

Refer now to FIG. 2A of the drawings which illustrates a case 10 which has the field 12 on side 11 arranged like a soccer field. The field 12 is preferably colored a shade of green and has either the hook or loop material of a self adhering fastener such as VELCRO®.

The field 12 has a goal 14 at one end and another goal 16 at the opposite end. The area of the field of play is laid out with multiple circles 18, 20, 22 that are preferably of different colors, such as a darker shade of green than that of the field 12 for 18, red for 20 and blue for 22. The circles 18, 20, 22 represent positions on which a game token 28 will be positioned or advanced to during play of the game. Located near each goal 14, 16 are circles 20 that are laid out in a triangular pattern that is referred to as a red zone or defensive zone. A white center line 24 is extended across the center of the field 12 with a large white circle 26 being at the center of the field 12. One circle 22 is positioned at a mid-point between the center line and the goal 14 and another circle 22 at the mid-point between the goal 16 and the center line 24. Another circle 22 is placed at the center of the playing field 12 within the circle 26.

The token 28 will be advanced on the circles 18, 20, 22 either forwardly, backwardly, to the left or the right during the play of the game depending on the play selection which will be later explained.

Figure 2B:
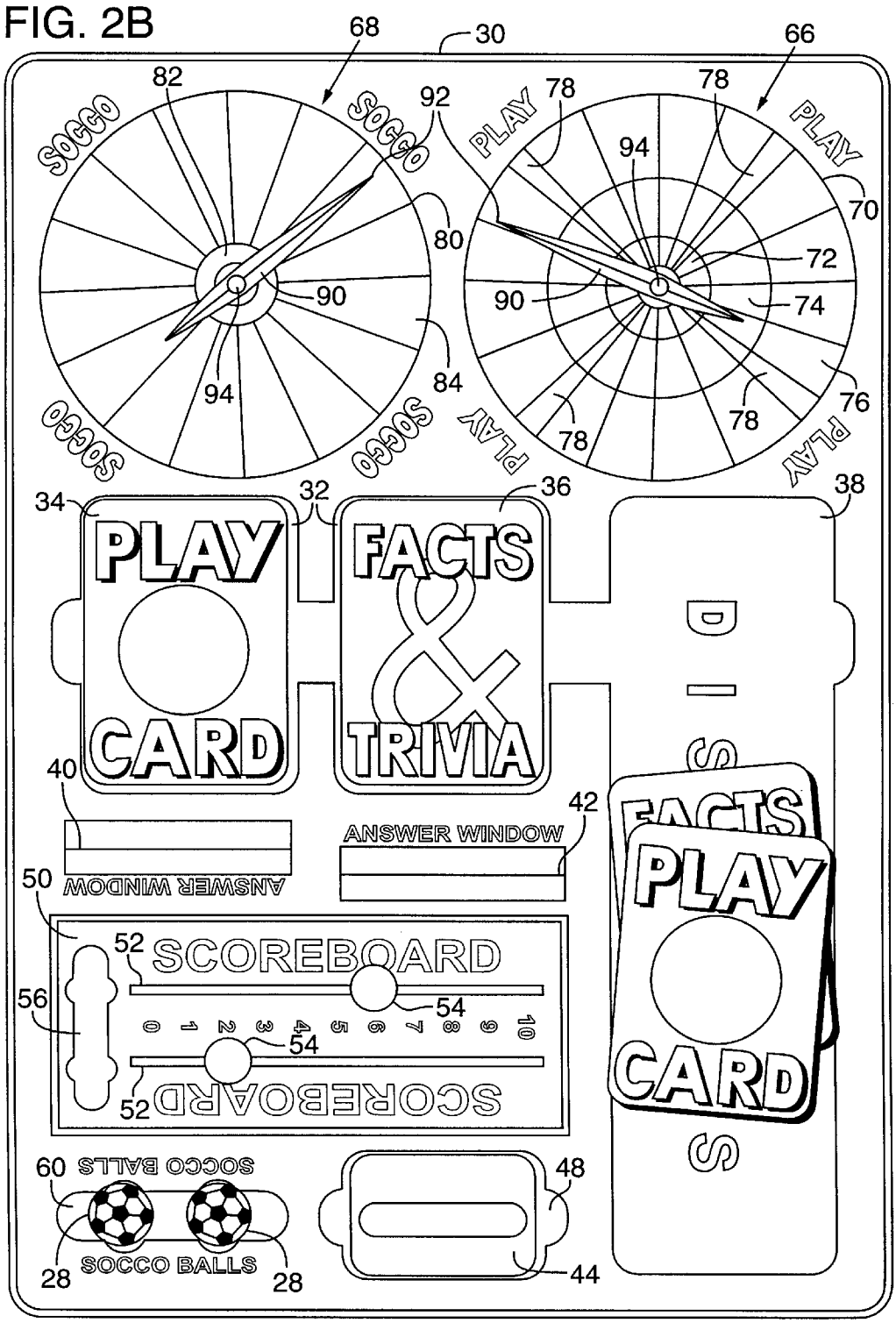
FIG. 2B is a view of the other side of the case of FIG. 1 arranged with articles to play learning game.

The opposite side 30 (FIG. 2B) of the case 10 houses all of the items necessary for playing the game. In this embodiment, the side 30 has recesses (trays) 32 for receiving two stacks of playing cards 34, 36 and also has a recess (tray) 38 suitable for receiving discarded cards from the either of the stacks 34, 36. The cards 34, 36 in this embodiment are of three types. One type is a play card which has questions about the game of soccer. Another card is a facts and trivia card which deals with soccer related information and a chance card which either allows a free spin on the spinner 66 or makes a member lose a turn of play. The spinner 66 is later explained.

Slots 40, 42 are provided for receiving answer windows 44, the answer windows being utilized to de-scramble the answer on the playing cards 34, 36. The slots 40, 42 are provided to hold the answer windows 44 during play and a recess (tray) 48 is provided for storing the answer windows 44 when not in use. The correct answers on the cards 34, 36 are scrambled by overlying multi-colored printing which prevents viewing the answer on the cards 34, 36 with the naked eye. The answer window 44 has a colored window which when placed over the answer on either of the cards 34, 36 permits viewing the answer by a member. The answer window 44 may also be held in hand for revealing the answer on the cards 34, 36.

Figure 3:
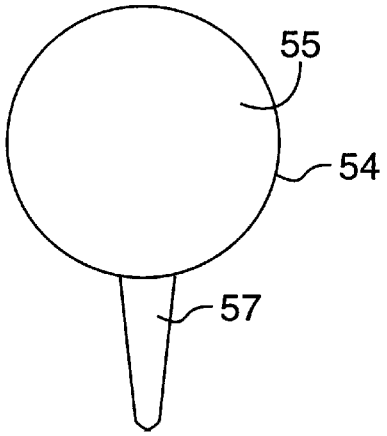
FIG. 3 is a view of a score marker for the learning game of FIGS. 2A and 2B.

A scoreboard 50 is provided for keeping track of the scores made by each of the opposing teams. The scoreboard 50 has a slot 52 for each team in which a score marker 54 will be placed. In this embodiment, each slot 52 is graduated and numbered from zero to ten. A recess (tray) 56 is provided for storing the score markers 54. The score marker 54 is further illustrated in FIG. 3. The score marker 54 has a circular disk 55 for ease of grasping by a team member and has an extending tab 57 that extends from the circular disk 55 and is arranged to fit in the slots 52 of the scoreboard 50.

Figure 4:
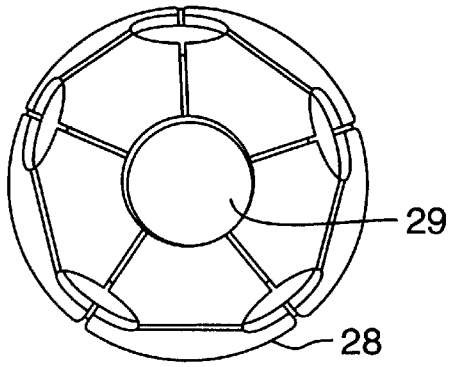
FIG. 4 is a view of a game token for the learning game of FIGS. 2A and 2B.

Another recess (tray) 60 is provided for storing the playing tokens 28 of the game. The playing tokens 28 are further illustrated in FIG. 4. The playing tokens 28 are spherical and have the appearance of a soccer ball. Circular portions 29 of the tokens 28 have either the loop or the hook material of a self-adhering fastener such as VELCRO® applied. The playing tokens 28 will thus adhere to the field 12 of the case 10 and particularly to the circles 18, 20, 22.

The side 30 has two chance selection devices, such as spinners 66, 68. Spinner 66 has a circular disk 70. The circular disk 70 has a center circle 72 and two rings 74, 76 that are concentric with the center circle 72. The disk 70 is divided into sectors. The portion of the sectors within the rings 74, 76 contain information on playing the game such as the advancement of the token 28, loss of turn and so forth. The information in each of the sectors of the ring 74 may, for example, have individual items such as goal, shoot again, goalie save, defensive steal, blocked shoot again, hit bar shoot: again, over the top, wide left, wide right, and so forth. It will be appreciated that some of the items, such as goal, may be duplicated at many of the sectors. The sectors in the ring 76 contain information about moving the play token 28 and, for example, a sector may have information such as go back 3, ball (token 28) stolen lose a turn, forward 6 left 4, right 3 forward 6, spin again, forward 3 right 3, forward 4, left 3, forward 5, and so forth. Additionally, the disk 70 has four sectors 78 that apply to both of the rings 74, 76 and in this embodiment, they are labeled SOCCO™. The center circle 72 has the numerals 1–8 inclusive at spaced intervals.

The spinner 68 has a disk 80. The disk 80 has a center circle 82 and a ring 84 concentric to the circle 82. The disk 80 is divided into sectors and each sector within the ring 84 contains play information about the game such as whether or not a goal is scored, loss of turn, advancement of the token 28 and so forth. The individual sectors have, in this embodiment, play information such as goal, lose a turn, spin again, add one point and spin again, spin again, go to first line in the red zone, add two points and spin again, add one point and spin again, and so forth.

Figure 5:
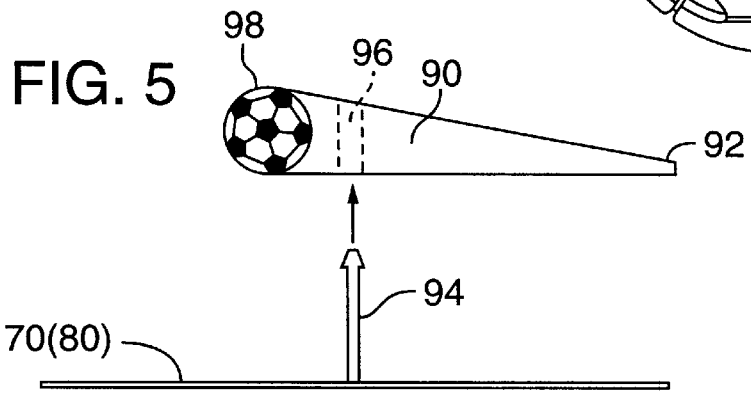
FIG. 5 is a view illustrating the mounting of an indicator of a random selection device of the learning game of FIGS. 2A and 2B; and, FIG. 6 is a view similar to FIG. 2B illustrating another arrangement of the other side of the case.

Each spinner 66, 68 has an indicator 90 that is rotatably mounted on a shaft 94 extending from the center of each disk 70, 80 in a conventional manner (see FIG. 5). The indicator 90 has a bore 96 at its balance point to receive the shaft 94. The indicator 90 has an extending pointer 92 and a circular disk 98 opposite the pointer 92. The disk 98 counterbalances the pointer 92 and provides a contact area to rotate (spin) the indicator 90.

Figure 6:
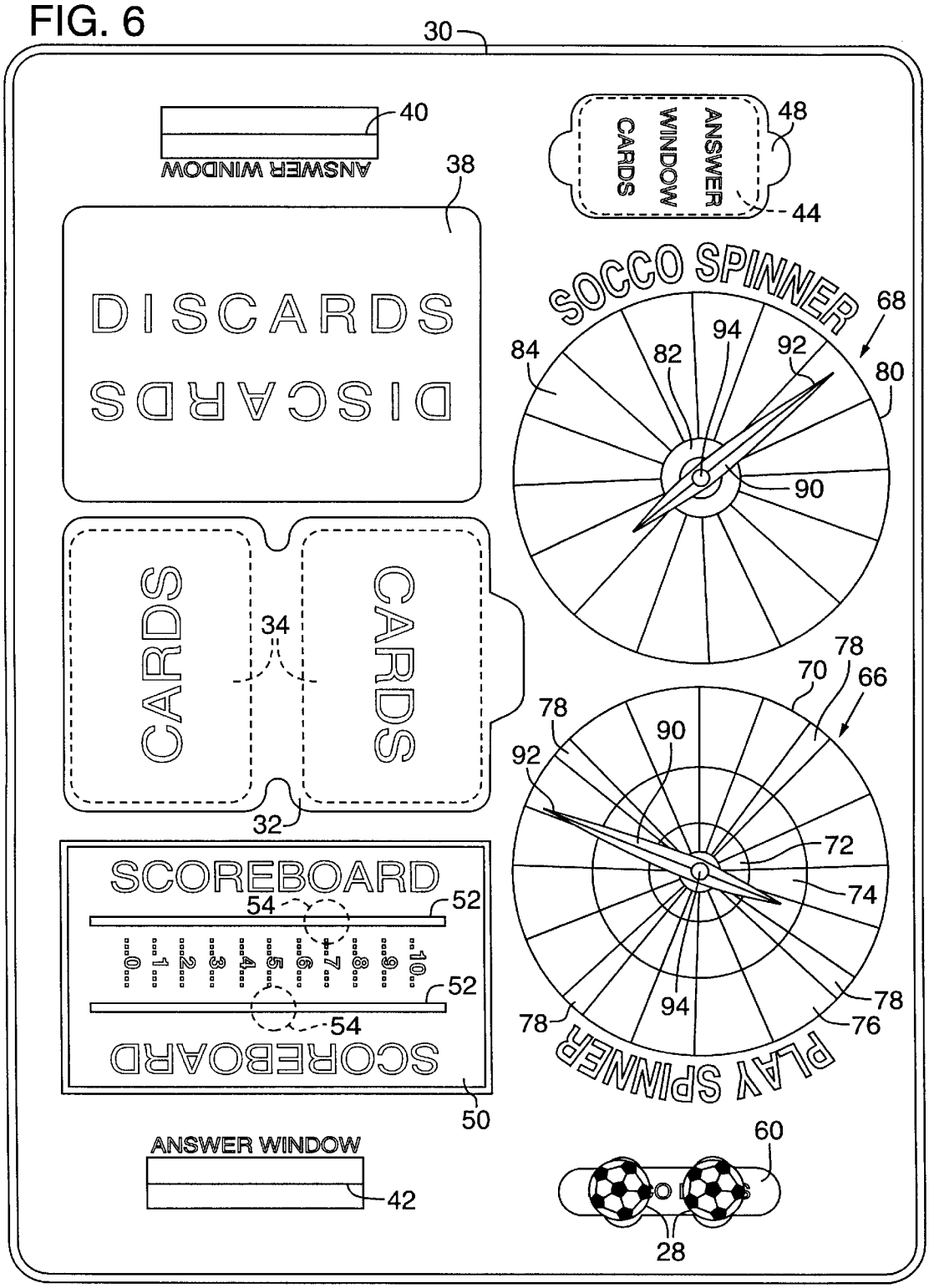

FIG. 6 illustrates another arrangement of the side 30 of the case 10. The score markers 54 in the arrangement of FIG. 6 are simply utilized and stored in the slots 52 of the scoreboard 50 and do not have a separate tray 56 for storage. The arrangements of the side 30 as shown in FIGS. 2A and 6 are arranged for the ease of the players (team members) to utilize the articles in the play of the game. It will be appreciated that the side 30 may be arranged in other ways to suit the game applied to the case 10.

The game is most often played by two teams, each team having one or more members. The game may however be played by a single individual. To start the game, a member from each team spins the indicator 90 on the spinner 66. The member will simply flick the disk 98 of the indicator 90 with a finger to cause the indicator to rotate. The team which has the pointer 92 of the indicator 90 landing on the highest number in the circle 72 has the first choice of play. Conversely, the teams may decide that the lowest number will have the first choice of play. The cards are shuffled and are placed into substantially evenly divided stacks 34, 36 in the trays 32. The score markers 54 are placed in the slots 52 of the score board 50 and are placed at the zero position. The team that was selected to go first places their token 28 on any of the four circles 18 touching the center blue circle 22. The defenders place their token 28 on any one of the red circles 20 in the row designated as 21.

One player on the offense draws a card from either of the two stacks 34, 36. As previously mentioned, the cards are of three types wherein one is a game card which asks questions about the game of soccer, the second type asks questions about facts and trivia which deal with soccer related information and the third card type is a chance card which either allows a free spin or makes you lose a turn. When a play card or facts and trivia card is drawn, the player who drew the card must answer correctly or the opposing team takes possession. When the question is answered correctly, the player spins the spinner 66 and by using the outside ring 76 of the disk 70 moves according to which sector the pointer 92 of the spinner 90 lands on. The player advances the token 28 according to the information on the sector in which the point 92 lands on unless the pointer lands on a sector that determines that play reverts to the opposing team. When the pointer 92 lands on a sector that advances the token 28, the player will advance according to the instructions on the sector and then once again will draw a card from either of the stacks 34, 36. This type of play continues until the player misses a question, loses a turn, scores or goes out of bounds.

Whenever possession changes hands during play other than when a goal is made or the player goes out of bound, the new offensive team places their token 28 in the center blue dot 22 and the defense places their ball (token 28) on any one of the circles 20 in the row 21 nearest their goal.

When the player has advanced to spin spinner 66 and the pointer 92 lands on one of the sectors labeled SOCCO™, that individual then has an opportunity to spin the spinner 68. The spinner 68 affords the player an opportunity to increase his scoring capability yet has items on some of the sectors that will cause a turn over.

When a player has spun the spinner 66 and the pointer 92 has landed on a sector that would place his token 28 out of bounds, possession reverts to the opposing team and the opposing team takes over on the dot where the ball (token 28) went out of bounds. The team that lost possession must then assume a defensive position in their defensive zone, that is, on one of the red circles 20 in line 21. The team taking possession after the ball (token 28) goes out of bounds starts by placing their ball (token 28) on the dot where the opponent's ball (token 28) went out. Using the spinner 66, the player will spin the spinner 90 and will use the numbers in the inner circle 72 to determine how may spaces the token is moved toward the center of the field.

During play, when a spinner has progressed to the spinner 66 and has spun and obtained instructions to move his token so that his token crosses or lands on the circle 20 that the defense ball (token 28) was on, possession is lost to the opponent. The opponent then starts his move from the dot his defense ball (token 28) is on. The player losing possession assumes a defense position. That is, he places his token 28 on one of the red circles 20 in line 21 near his goal.

In this embodiment, the cards utilized in playing the game have questions directed to the game of soccer. It will be appreciated that other subject matter may be utilized for the learning process and the cards could, for example, have questions relating to math operations, such as addition, division, subtraction and multiplication. Other subject matter may well be incorporated as well. The subject matter on the cards is selected to be appropriate for a particular age group.

There are many variations that may be incorporated to change the play of the game. Those skilled in the art will recognize that modifications and variations may be made without departing from the true spirit and scope of the invention. The invention is therefore not to be limited to the embodiments described and illustrated but is to be determined from the appended claims.

I claim:

1. A method of playing a board game whereby players play a game and learn a sport represented by the game, which comprises:

(a) providing a game board with a playing surface having indicia consisting of only one field of play representing a sporting event played by opposing teams on the field of play, providing a plurality of tokens, assigning one or more tokens to each player, each player placing their one or more tokens on at least one starting position on said field of play, wherein each token represents an opposing team in a sporting event played on said field of play, said field of play having indicia representing spaces or positions of advancement dispersed about the field of play wherein different directions of movement are possible including forward direction of movement, backward direction of movement, right direction of movement or left direction of movement, said field of play having two goal positions at opposite ends of the field of play or a common goal position for all players, assigning said goal position for each player or players to advance toward, providing playing cards having questions relating to the sport event and a chance selection device providing a random chance of advancement on the field of play;

(b) assigning one of the players an advancement opportunity, and selecting a playing card having questions that challenge the player's knowledge of the sport event, the correct answer allowing the player to make a chance selection on said chance selection device;

(c) said player making a chance selection on said chance selection device;

(d) advancing an advancement token which is moved on the field of play having varying consequences as determined by the chance selection device and the starting positions of the token;

(e) said player repeating the steps of (b), (c) and (d) until one or more questions are answered incorrectly or one or more chance selection or advancements of the advancement token dictates termination of the play of the player;

(f) shifting the advancement opportunity to the other player and the other player pursuing steps b–e; and (g) continuing the alternation of player until the game is concluded.

2. A method as defined in claim 1, further including:

(f) selecting two players to play the game;

(g) determining one of the players for pursuing a scoring opportunity as defined in steps b–e;

(h) shifting the advancement opportunity to the other player and pursuing steps b–e; and (i) continuing the alternation of players until the game is concluded.

* * * * *